US007762554B2

(12) United States Patent
Ho

(10) Patent No.: US 7,762,554 B2
(45) Date of Patent: Jul. 27, 2010

(54) CARD OUTPUT DEVICE FOR SHUFFLING MACHINE

(75) Inventor: Cai-Shiang Ho, Taipei (TW)

(73) Assignee: Taiwan Fulgent Enterprise Co., Ltd., Taipei (TW)

( * ) Notice: Subject to any disclaimer, the term of this patent is extended or adjusted under 35 U.S.C. 154(b) by 124 days.

(21) Appl. No.: 12/245,493

(22) Filed: Oct. 3, 2008

(65) Prior Publication Data

US 2010/0084813 A1 Apr. 8, 2010

(51) Int. Cl.
*A63F 1/12* (2006.01)
*A63F 1/14* (2006.01)

(52) U.S. Cl. ..... 273/149 R; 463/22

(58) Field of Classification Search ..... 273/149 R, 273/149 P; 463/22
See application file for complete search history.

(56) References Cited

U.S. PATENT DOCUMENTS 3,929,339 A * 12/1975 Mattioli ..... 273/148 A
4,586,712 A * 5/1986 Lorber et al. ..... 273/149 R
4,659,082 A * 4/1987 Greenberg ..... 273/149 R
4,770,421 A * 9/1988 Hoffman ..... 273/149 R
4,807,884 A * 2/1989 Breeding ..... 273/149 R
4,969,648 A * 11/1990 Hollinger et al. ..... 273/149 R
5,356,145 A * 10/1994 Verschoor ..... 273/149 R
5,722,893 A * 3/1998 Hill et al. ..... 463/47
6,254,096 B1 * 7/2001 Grauzer et al. ..... 273/149 R

* cited by examiner

*Primary Examiner*—Benjamin H Layno
(74) *Attorney, Agent, or Firm*—Apex Juris, pllc; Tracy M Heims

(57) ABSTRACT

A card output device for a shuffling machine is mounted adjacent to a shuffling wheel of a shuffling device and has a housing and a stacking assembly, a pushing assembly and three sensors being mounted in the housing. When the sensors sense that there are cards on the stacking assembly, the stacking assembly and the pushing assembly begin to push the cards toward an outlet of the housing and the shuffling device stops pushing the cards out of the shuffling wheel. When there are fewer cards being stacked in the outlet of the housing, the shuffling device begins to push the cards out of the shuffling wheel and into the card output device. Therefore, the cards are not scattered around the outlet of the card output device and keep a desk for playing a card game neat and tidy.

12 Claims, 9 Drawing Sheets

CARD OUTPUT DEVICE FOR SHUFFLING MACHINE

BACKGROUND OF THE INVENTION

1. Field of the Invention

The present invention relates to a card output device, especially to a card output device for a shuffling machine that controls the shuffling machine to output cards or not.

2. Description of the Prior Arts

Shuffling is to randomize a deck of cards and is an important procedure for a card game. Thus, the card game needs a dealer to shuffle and deal the cards with his hands. However, since shuffling with hands makes cheat possible, is slow and injuries the dealer's hands with repetitive motions, a shuffling machine is designed in order to fairly, fast and automatically shuffling the cards.

A conventional shuffling machine comprises a shuffling device, a card input device and a card output device.

The shuffling device has a shuffling wheel, a controller and a discharging device. The shuffling wheel has multiple card slots being formed radially around the shuffling wheel. Each card slot allows multiple cards being stored inside the card slot. The controller is electrically connected to the shuffling wheel and controls the shuffling wheel to rotate in a random direction by a random number of degrees. The discharging device is mounted on the shuffling wheel and selectively corresponds to one of the card slot of the shuffling wheel to push the cards being stored inside the card slot out of the card slot.

The card input device is mounted adjacent to the shuffling wheel, allows multiple decks of cards being placed in the card input device and draws the cards one by one into the card slots of the shuffling wheel of the shuffling device.

The card output device is mounted adjacent to the shuffling wheel, is opposite to the card input device and receives the cards being pushed out of the card slots of the shuffling wheel.

Since the shuffling wheel rotates in a random direction by a random number of degrees, the cards being placed on the card input device are randomly stored in and pushed out of the card slots of the shuffling wheel. Then, the dealer takes cards from the card output device in sequence and deals the cards to players of the card game.

However, the conventional shuffling machine outputs cards continuously as long as there are cards in the card slots of the shuffling wheel. Therefore, when a dealer dealing cards slower than the shuffling machine outputting cards, or the players have had enough cards for a card game and the dealing work is paused, the cards being output from the shuffling machine are scattered around the card output device causing a chaos on a desk and, even more, interrupting after card games.

To overcome the shortcomings, the present invention provides a card output device for a shuffling machine to mitigate or obviate the aforementioned problems.

SUMMARY OF THE INVENTION

The main objective of the present invention is to provide a card output device for a shuffling machine. The card output device is mounted adjacent to a shuffling wheel of a shuffling device and has a housing, a stacking assembly, a pushing assembly and three sensors being mounted in the housing.

When the sensors sense that there are cards on the stacking assembly, the stacking assembly and the pushing assembly begin to push the cards toward an outlet of the housing and the shuffling device stops pushing the cards out of the shuffling wheel. When there are fewer cards being stacked in the outlet of the housing, the shuffling device begins to push the cards out of the shuffling wheel and into the card output device.

Therefore, the cards are not scattered around the outlet of the card output device and keep a desk for playing a card game neat and tidy.

Other objectives, advantages and novel features of the invention will become more apparent from the following detailed description when taken in conjunction with the accompanying drawings.

DETAILED DESCRIPTION OF THE PREFERRED EMBODIMENTS

Figure 2:
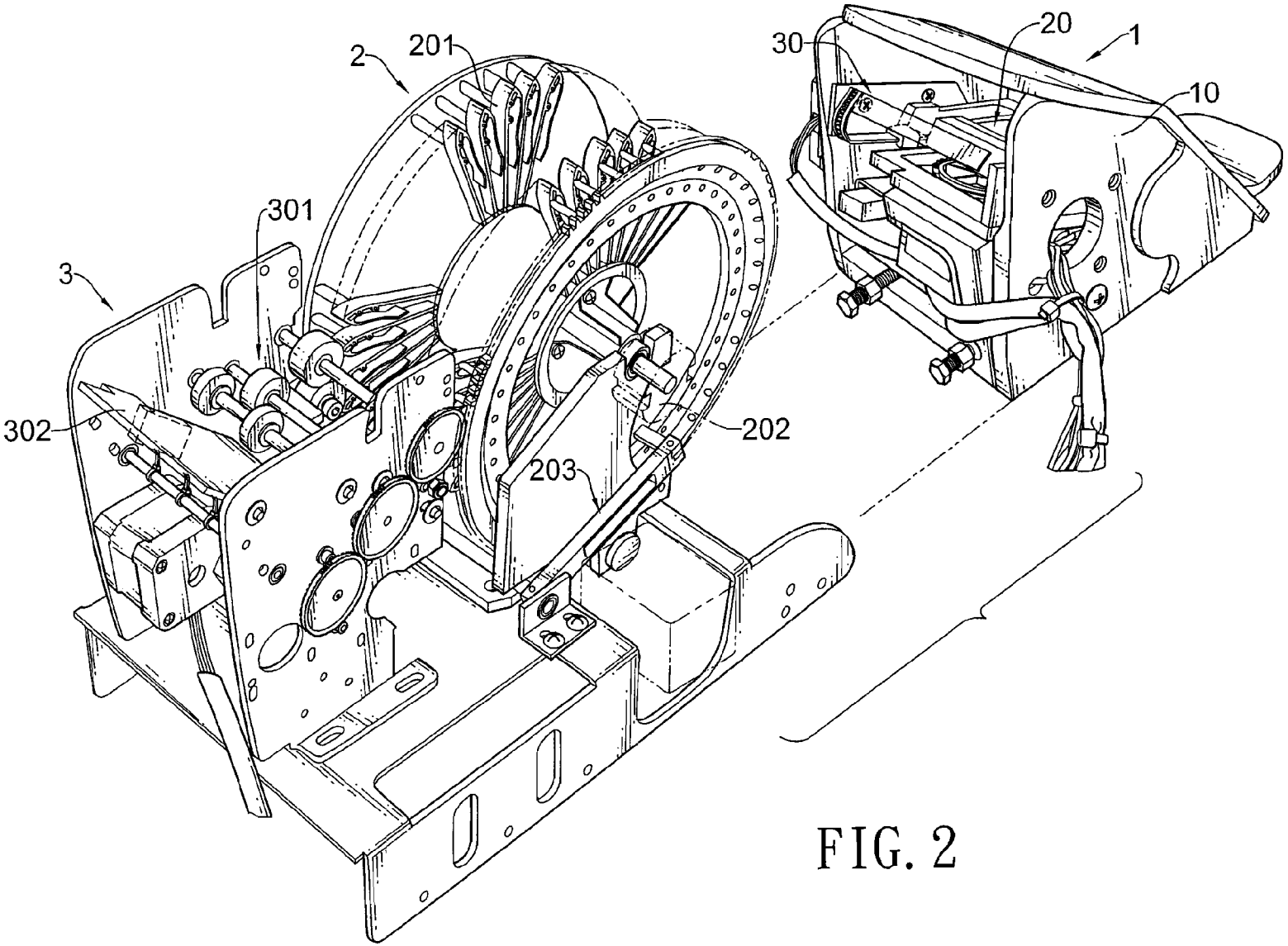
FIG. 2 is an exploded perspective view of a shuffling machine having the card output device in FIG. 1.
Figure 3:
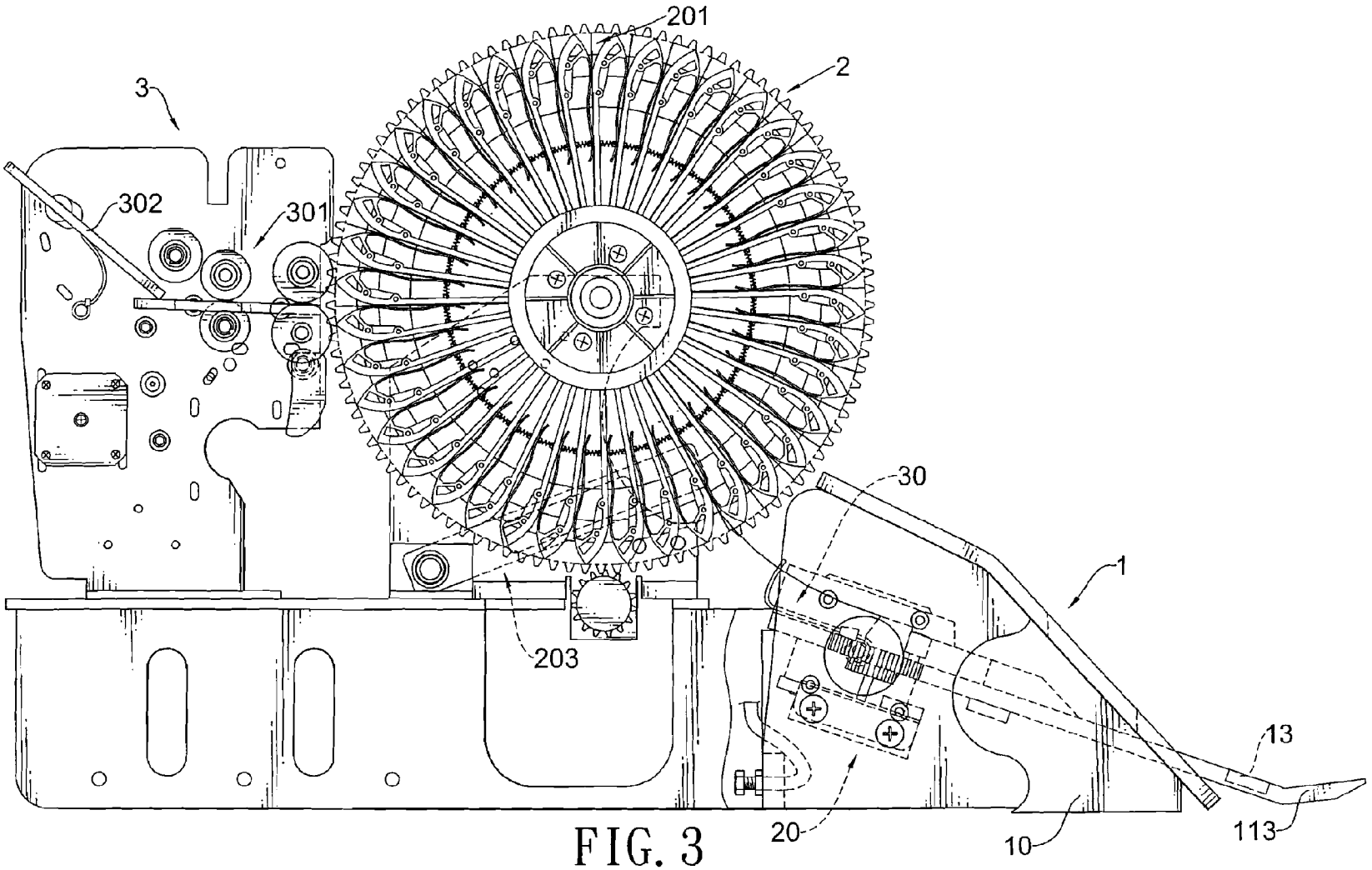
FIG. 3 is a side view of the shuffling machine in FIG. 2.
Figure 4:
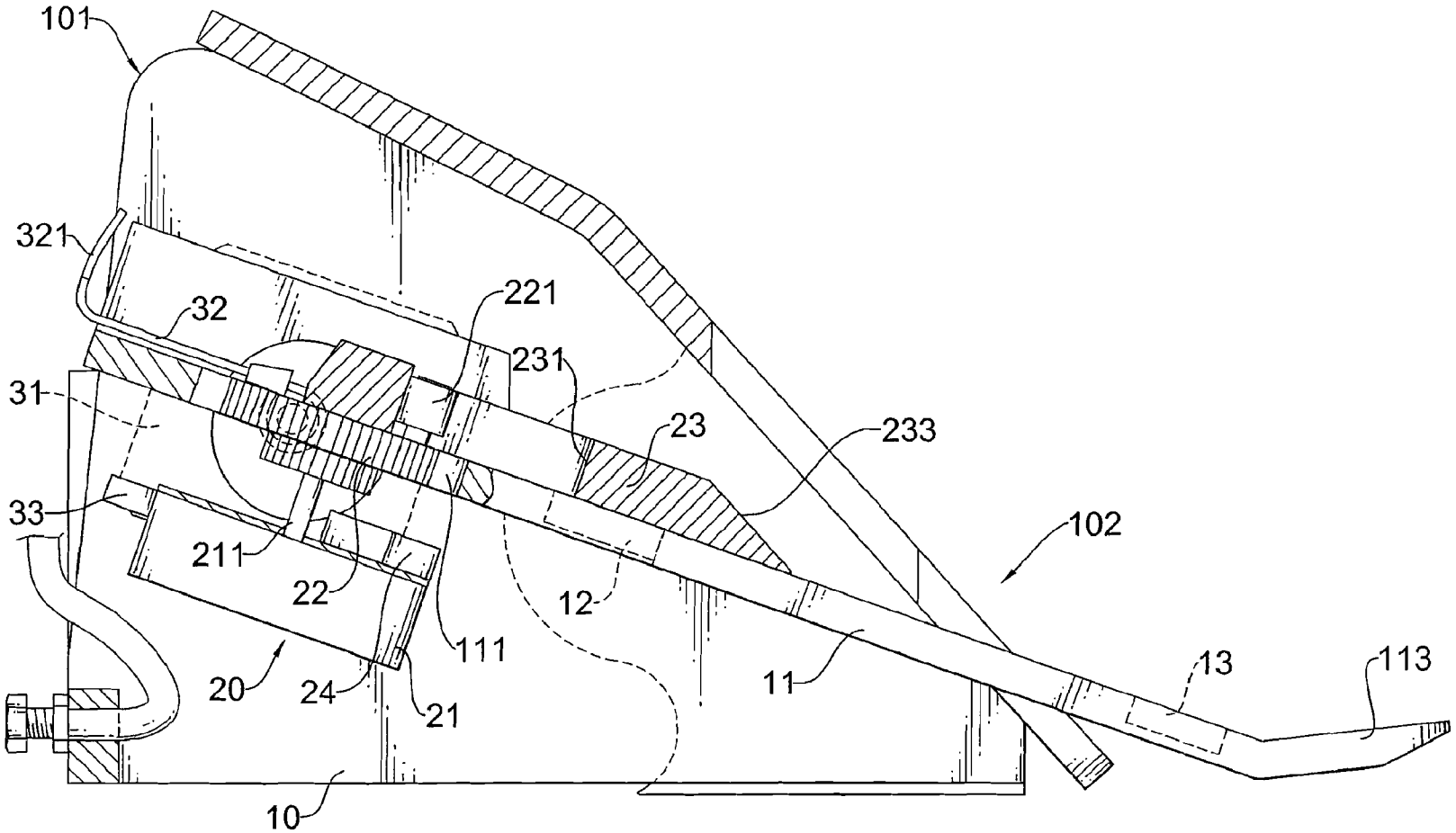
FIG. 4 is a side view in partial section of the card output device in FIG. 1.

With reference to FIGS. 2 and 3, a shuffling machine has a shuffling device (2), a card input device (3) and a card output device (1) in accordance with the present invention.

The shuffling device (2) comprises a shuffling wheel (201), a controller (202) and a discharging assembly (203). The shuffling wheel (201) has two opposite sides and multiple card slots. The card slots are formed radially around the shuffling wheel (201). Each card slot allows multiple cards being stored inside the card slot. The controller (202) is electrically connected to the shuffling wheel (201) and controls the shuffling wheel (201) to rotate in a random direction by a random number of degrees. The discharging assembly (203) is mounted on the shuffling wheel (201) and selectively corresponds to one of the card slot of the shuffling wheel (201) to push the cards being stored inside the card slot to leave the card slot.

The card input device (3) is mounted adjacent to one side of the shuffling wheel (201) of the shuffling device (2) and comprises a swiveling panel (302) and multiple rollers (301). The swiveling panel (302) is pivotally and slantwise mounted in the card input device (3), selectively pivots and allows multiple decks of cards being placed on the swiveling panel (302). The rollers (301) are parallelly and rotatably mounted in the card input device (3) between the swiveling panel (302) and the shuffling wheel (201) of the shuffling device (2).

When the swiveling panel (302) pivots, the decks of cards are drawn and conveyed one by one by the rollers (301) and into the card slots of the shuffling wheel (201) of the shuffling device (2).

Figure 1:
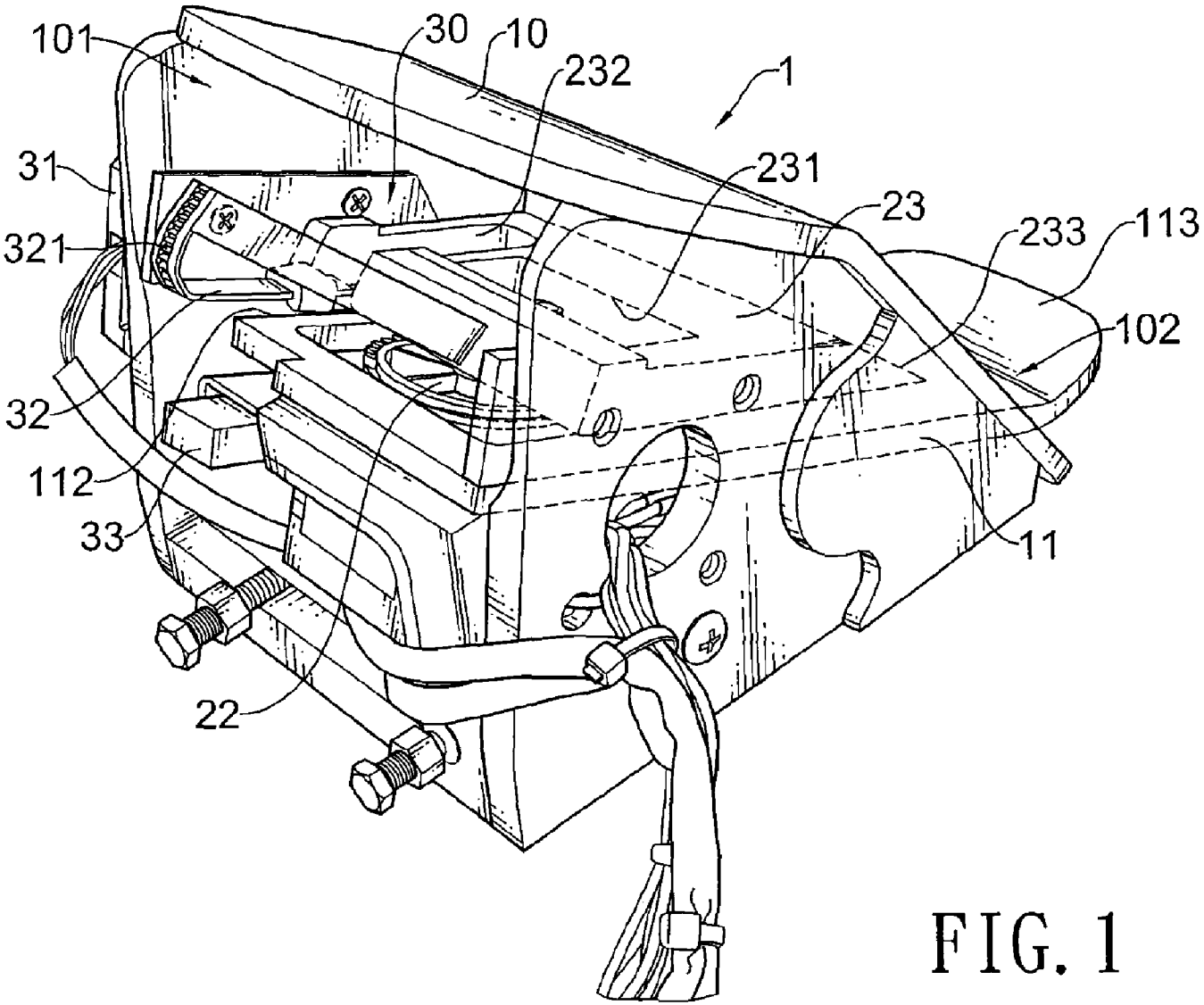
FIG. 1 is a perspective view of a card output device for a shuffling machine in accordance with the present invention.

With further reference to FIG. 1, the card output device (1) in accordance with the present invention is mounted adjacent to another side of the shuffling wheel (201) of the shuffling device (2) opposite to the card input device (3) and comprises a housing (10), a stacking assembly (20) and an optional pushing assembly (30).

With further reference to FIGS. 4 to 7, the housing (10) has an inlet (101), an outlet (102), a dealing panel (11) and a first sensor (12) and may have an identification device (13). The outlet (102) of the housing (10) is opposite to the inlet (101) of the housing (10). The dealing panel (11) is mounted in the housing (10), is downward from the inlet (101) to the outlet (102) of the housing (10), has an upper surface, a lower surface, an upper edge, a lower edge (113) and a through hole (111) and may have an elongated slot (112). The lower edge (113) of the dealing panel (11) protrudes out of the outlet (102) of the housing (10) and may be bent upwardly in order to taking the cards easily. The through hole (111) is formed through the dealing panel (11) adjacent to the upper edge of the dealing panel (11). The elongated slot (112) is formed in the upper edge of the dealing panel (11) beside the through hole (111) of the dealing panel (11).

Figure 9A:
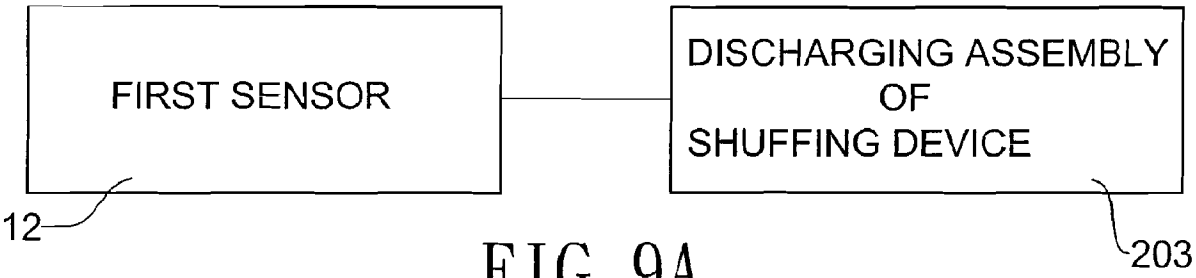
FIG. 9A is a block diagram of a first sensor on the card output device in FIG. 1.

With further reference to FIG. 9A, the first sensor (12) is embedded in the upper surface of the dealing panel (11) near the outlet (102) of the housing (10), may be mounted in the elongated slot (112) of the dealing panel (11) and is electrically connected to the discharging assembly (203) of the shuffling device (2) to drive the discharging assembly (203) to push the cards out of the card slots of the shuffling wheel (201).

The identification device (13) is embedded in the upper surface of the dealing panel (11) adjacent to the lower edge (113) of the dealing panel (11) to identify suits and ranks of each cards being taken from the dealing panel (11) of the housing (10).

The stacking assembly (20) is mounted in the housing (10) under the dealing panel (11), corresponds to the through hole (111) of the dealing panel (11) and has a motor (21), a shaft (211), a sliding panel (23), a rotor (22) and a second sensor (24).

The motor (21) is mounted in the housing (10) under the dealing panel (11), corresponds to the through hole (111) of the dealing panel (11).

The shaft (211) is driven by the motor (21) and rotatably protrudes through the through hole (111) of the dealing panel (11).

The sliding panel (23) is mounted on the upper surface of the dealing panel (11), may be metal, is connected to the shaft (211) of the motor (21) of the stacking assembly (20), has an upper edge, a lower edge, an inner edge, a through hole (231) and may have an elongated slot (232) and a slope (233). The through hole (231) is formed through the sliding panel (23) adjacent to the upper edge of the sliding panel (23) and corresponds to the through hole (111) of the dealing panel (11). The elongated slot (232) is formed in the upper edge of the sliding panel (23) beside the through hole (231) of the sliding panel (23) and corresponds to the elongated slot (112) of the dealing panel (11). The slope (233) is formed on the lower edge of the sliding panel (23).

The rotor (22) is securely mounted around and is driven by the shaft (211) of the motor (21), may be a disk and has an upper surface and a driving rod (221). The driving rod (221) is securely mounted eccentrically on the upper surface of the rotor (22), protrudes in the through holes (111, 231) of the dealing panel (11) and the sliding panel (23) and abuts the inner edge of the sliding panel (23).

Figure 5:
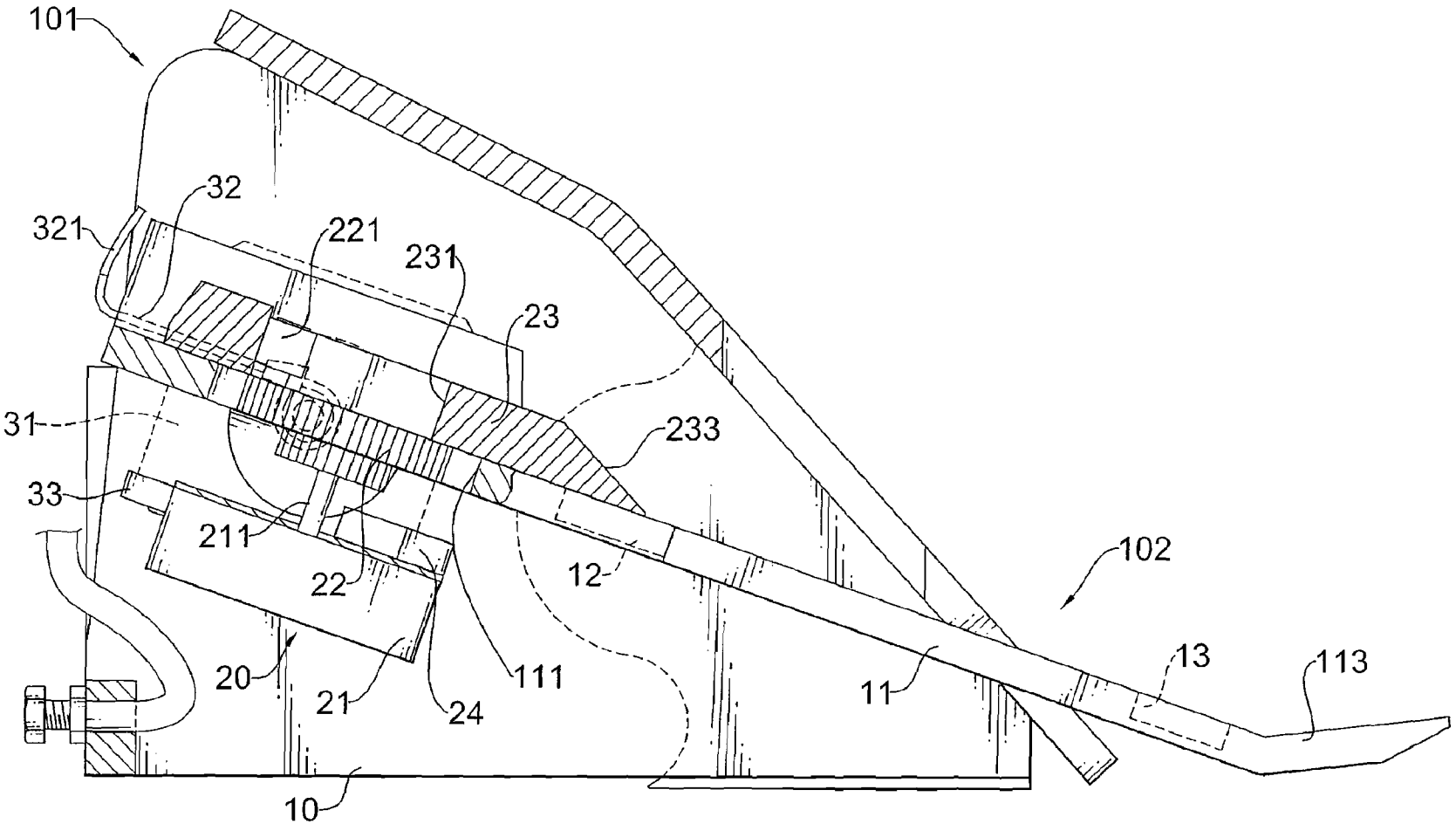
FIG. 5 is an operational side view in partial section of the card output device in FIG. 1, showing a sliding panel sliding upward.
Figure 8:
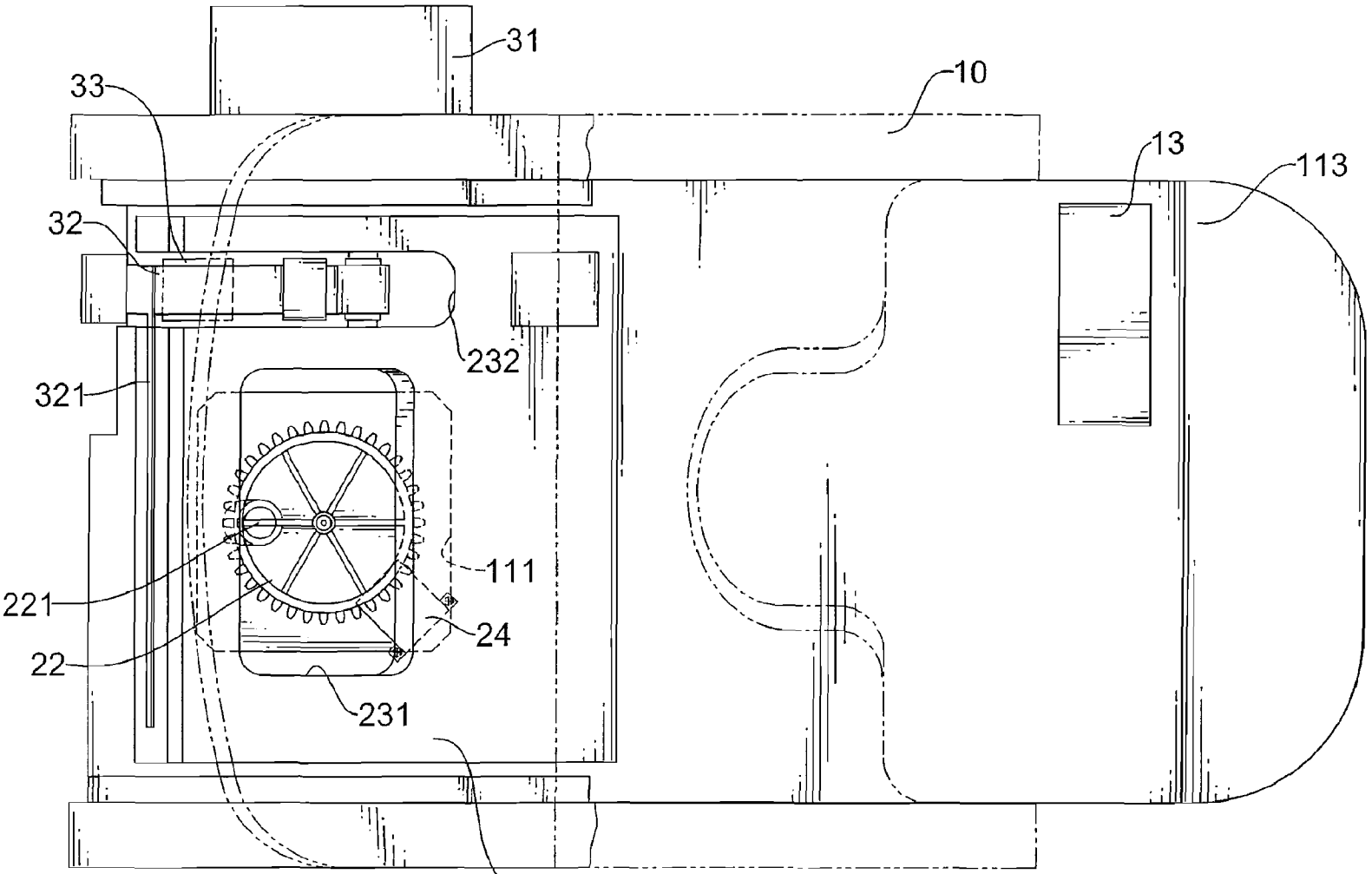
FIG. 8 is an operational top view of the card output device in FIG. 1, showing a housing in phantom lines.

With further reference to FIGS. 5 and 8, when the driving rod (221) of the rotor (22) revolve around the shaft (211) of the motor (21) and moves toward the lower edge (113) of the dealing panel (11), the driving rod (221) pushes the sliding panel (23) to slide toward the lower edge (113) of the dealing panel (11). When the driving rod (221) of the rotor (22) rotates around the shaft (211) of the motor (21) and moves toward the upper edge of the dealing panel (11), the driving rod (221) pushes the sliding panel (23) to slide toward the upper edge of the dealing panel (11).

Figure 9B:
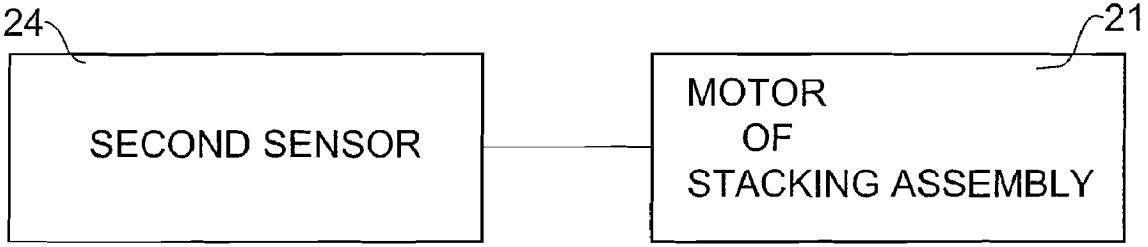
FIG. 9B is a block diagram of a second sensor on the card output device in FIG. 1.

With further reference to FIG. 9B, the second sensor (24) corresponds to the through holes (111, 231) of the dealing panel (11) and the sliding panel (23) and is mounted on and is electrically connected to and drives the motor (21) of the stacking assembly (20) to rotate the shaft (211) of the motor (21), to revolve the driving rod (221) of the rotor (22) and to drive the sliding panel (23) to slide upwards and downwards on the dealing panel (11).

The pushing assembly (30) is mounted on the housing (10) and has a motor (31), a pushing rod (32) and a third sensor (33).

The motor (31) is mounted on the housing (10) and has a shaft. The shaft of the motor (31) protrudes transversely into the housing (10).

Figure 6:
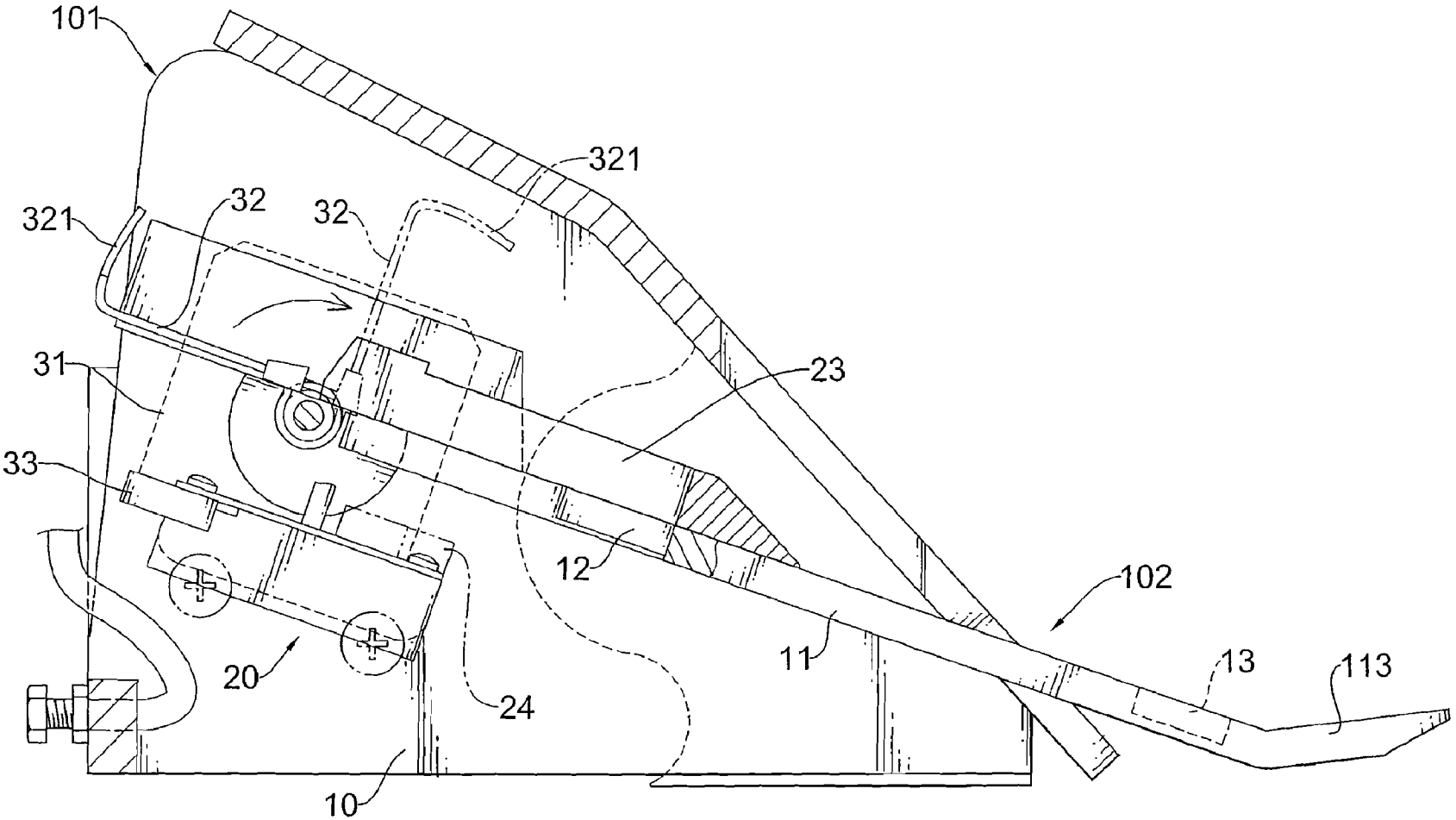
FIG. 6 is an operational side view in partial section of the card output device in FIG. 1, showing a pushing rod pivoting.
Figure 7:
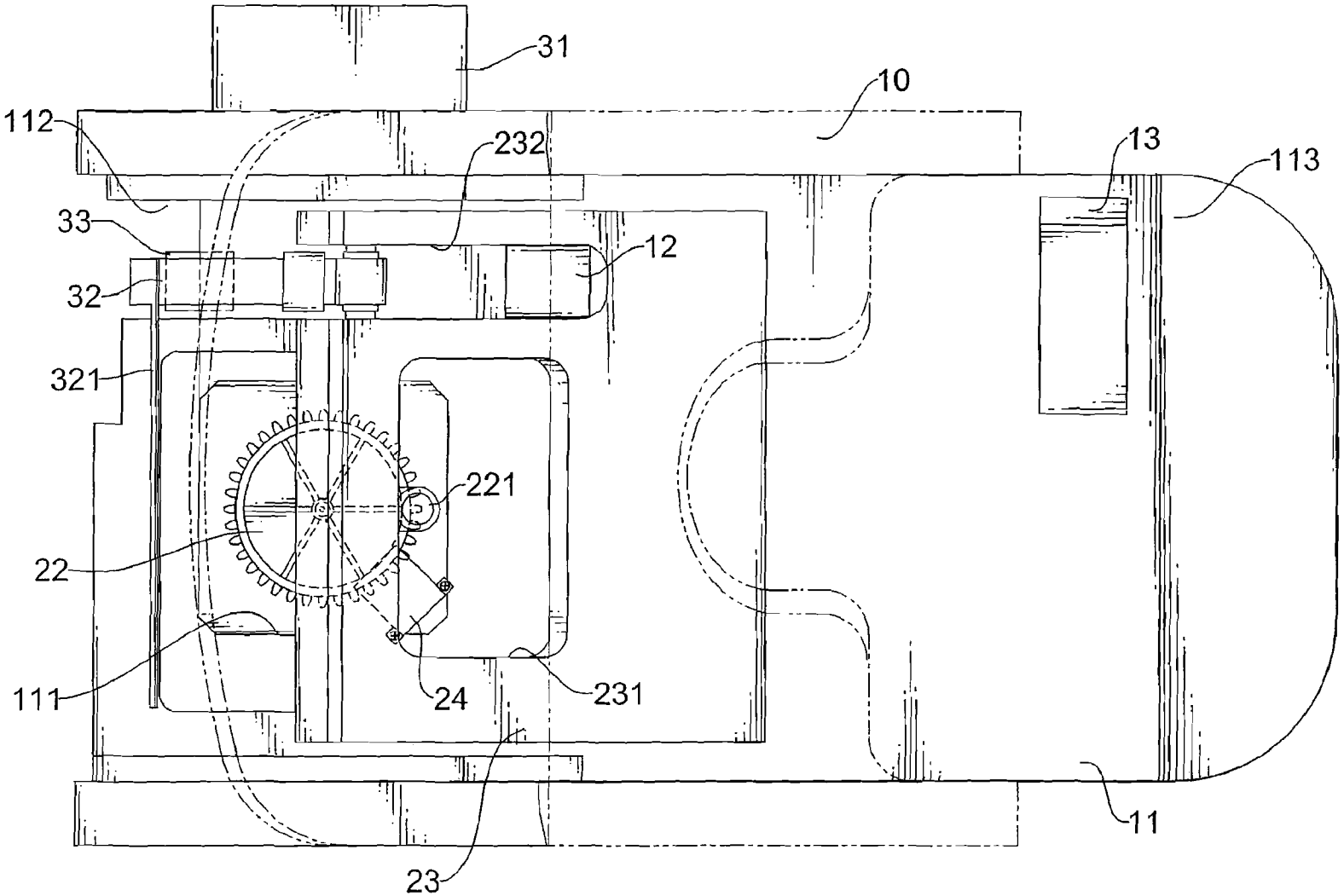
FIG. 7 is a top view of the card output device in FIG. 1, showing a housing in phantom lines.

With further reference to FIG. 6, the pushing rod (32) is securely mounted on and pivots with the shaft of the motor (31) of the pushing assembly (30) and is mounted near the inlet (101) of the housing (10), may be mounted along the elongated slot (112) of the dealing panel (11) and has a distal end and a hook (321). The hook (321) is formed on the distal end of the pushing rod (32), may be elongated, may be perpendicular to the pushing rod (32) and may be parallel to the upper edge of the dealing panel (11).

Figure 9C:
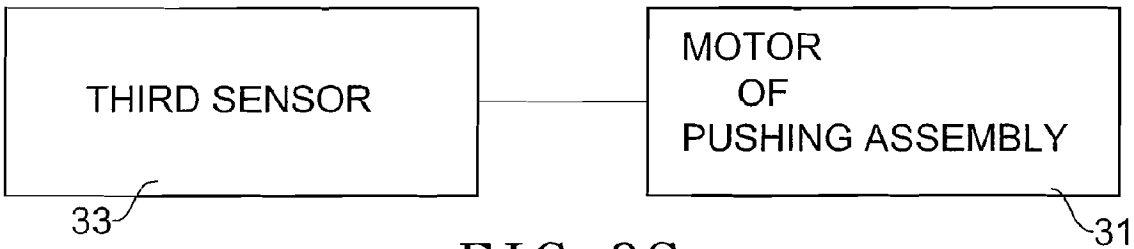
FIG. 9C is a block diagram of a third sensor on the card output device in FIG. 1.

With further reference to FIG. 9C, the third sensor (33) is mounted in the housing (10), under the dealing panel (11) and adjacent to the inlet (101) of the housing (10), may correspond to the elongated slot (112) of the dealing panel (11) and is electrically connected to and drives the motor (31) of the pushing assembly (30) to pivot the shaft of the motor (31) and the pushing rod (32) of the pushing assembly (30).

When the discharging assembly (203) of the shuffling device (2) pushes the cards out of the card slots of the shuffling wheel (201) of the shuffling device (2), the cards are stacked on the sliding panel (23).

First, the third sensor (33) of the pushing assembly (30) senses that the cards on the sliding panel (23) moves through the elongated slots (112, 232) of the dealing panel (11) and the sliding panel (23). Then the third sensor (33) of the pushing assembly (30) drives the motor (31) to pivot the shaft of the motor (31) and the pushing rod (32). Therefore, the hook (321) of the pushing rod (32) pushes the cards into the housing (10). Consequently, the cards move along the slope (233) of the sliding panel (23) and toward the outlet (102) of the housing (10).

Meanwhile, the second sensor (24) of the stacking assembly (20) senses that the cards on the sliding panel (23) and move through the through holes (111, 231) of the dealing panel (11) and the sliding panel (23). Then the second sensor (24) of the stacking assembly (20) drives the motor (21) to rotate the shaft (211) and to revolve the driving rod (221) of the rotor (22). Therefore, the sliding panel (23) slide upwards and downwards on the dealing panel (11). When the sliding panel (23) slides toward the lower edge (113) of the dealing panel (11), the slope (233) of the sliding panel (23) pushes up the cards being stacked in the outlet (102) of the housing (10). Thus, the cards being pushed by the pushing rod (32) of the pushing assembly (30) are inserted under the cards being pushed up by the sliding panel (23). When the sliding panel (23) slides toward the upper edge of the dealing panel (11), the cards being stacked in the outlet (102) of the housing (10) slides out of the housing (10). Thus, a dealer takes the cards one by one from top of the stacked cards and deals the cards to players of a card game. The bent lower edge (113) of the dealing panel (11) allows the dealer to take the cards easily. The identification device (13) being embedded in the dealing panel (11) allows staffs of a casino to monitor the suits and ranks of each cards and prevents the players to cheat by changing the cards stealthily.

When too many cards are stacked in the outlet (102) of the housing (10) to cover the first sensor (12), the first sensor (12) stops the discharging assembly (203) of the shuffling device (2) from pushing the cards out of the card slots of the shuffling wheel (201). Afterwards, if the dealer takes cards from the card output device (1) again and there are fewer cards being stacked in the outlet (102) of the housing (10), the first sensor (12) of the housing (10) drives the discharging assembly (203) of the shuffling device (2) to push the cards out of the card slots of the shuffling wheel (201) and into the card output device (1) again.

The card output device (1) for the shuffling machine as described has the following advantages. The card output device (1) controls the shuffling device (2) to output cards or not. Therefore, when the dealer dealing cards slower than the cards being stacked in the card output device (1) as described, or the dealing work is paused, the card output device (1) stops outputting cards. The cards are not scattered around the outlet (102) of the card output device (1) and keep a desk for playing the card game neat and tidy.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A card output device being mounted adjacent to a shuffling wheel of a shuffling device and comprising a housing having an inlet;

an outlet being opposite to the inlet of the housing;

a dealing panel being mounted in the housing, being downward from the inlet to the outlet of the housing and having an upper surface;

a lower surface protruding out of the outlet of the housing;

an upper edge;

a lower edge; and a through hole being formed through the dealing panel adjacent to the upper edge of the dealing panel; and a first sensor being embedded in the upper surface of the dealing panel near the outlet of the housing;

a stacking assembly being mounted in the housing under the dealing panel, corresponding to the through hole of the dealing panel and having a motor being mounted in the housing under the dealing panel, corresponding to the through hole of the dealing panel;

a shaft being driven by the motor and rotatably protruding through the through hole of the dealing panel;

a sliding panel being mounted on the upper surface of the dealing panel, being connected to the shaft of the motor of the stacking assembly and having an upper edge;

a lower edge; and a through hole being formed through the sliding panel adjacent to the upper edge of the sliding panel and corresponding to the through hole of the dealing panel; and a second sensor corresponding to the through holes of the dealing panel and the sliding panel and being mounted on and being electrically connected to the motor of the stacking assembly.

2. The card output device as claimed in claim 1 further has a pushing assembly being mounted on the housing and having a motor being mounted on the housing and having a shaft protruding transversely into the housing;

a pushing rod being securely mounted on and pivoting with the shaft of the motor of the pushing assembly and being mounted near the inlet of the housing and having a distal end; and a hook being formed on the distal end of the pushing rod; and a third sensor being mounted in the housing, under the dealing panel and adjacent to the inlet of the housing and being electrically connected to and driving the motor of the pushing assembly.

3. The card output device as claimed in claim 2, wherein the sliding panel of the stacking assembly further has an inner edge; and the stacking assembly further has a rotor being securely mounted around and is driven by the shaft of the motor of the stacking assembly and having an upper surface; and a driving rod being securely mounted eccentrically on the upper surface of the rotor, protruding in the through holes of the dealing panel and the sliding panel and abutting the inner edge of the sliding panel.

4. The card output device as claimed in claim 3, wherein the rotor of the stacking assembly is a disk.

5. The card output device as claimed in claim 2, wherein the sliding panel of the stacking assembly further has a slope being formed on the lower edge of the sliding panel.

6. The card output device as claimed in claim 2, wherein the dealing panel of the housing further has an elongated slot being formed in the upper edge of the dealing panel beside the through hole of the dealing panel;

the first sensor of the housing is mounted in the elongated slot of the dealing panel;

the sliding panel of the stacking assembly further has an elongated slot being formed in the upper edge of the sliding panel beside the through hole of the sliding panel and corresponding to the elongated slot of the dealing panel;

the pushing rod of the pushing assembly is mounted along the elongated slot of the dealing panel; and the third sensor of the pushing assembly corresponds to the elongated slot of the dealing panel.

7. The card output device as claimed in claim 2, wherein the hook of the pushing rod of the pushing assembly is elongated, perpendicular to the pushing rod and parallel to the upper edge of the dealing panel.

8. The card output device as claimed in claim 1, wherein the sliding panel of the stacking assembly further has an inner edge; and the stacking assembly further has a rotor being securely mounted around and is driven by the shaft of the motor of the stacking assembly and having an upper surface; and a driving rod being securely mounted eccentrically on the upper surface of the rotor, protruding in the through holes of the dealing panel and the sliding panel and abutting the inner edge of the sliding panel.

9. The card output device as claimed in claim 8, wherein the rotor of the stacking assembly is a disk.

10. The card output device as claimed in claim 1, wherein the sliding panel of the stacking assembly further has a slope being formed on the lower edge of the sliding panel.

11. The card output device as claimed in claim 1, wherein the lower edge of the dealing panel of the housing is bent upwardly.

12. The card output device as claimed in claim 11, wherein the housing further has an identification device being embedded in the upper surface of the dealing panel adjacent to the lower edge of the dealing panel.

* * * * *